US006227514B1

(12) United States Patent
Williams

(10) Patent No.: US 6,227,514 B1
(45) Date of Patent: May 8, 2001

(54) SUPPORT BRACKET

(75) Inventor: Kenneth C. Williams, Little Rock, AR (US)

(73) Assignee: Walk_Winn Plastic, Incorporated, Little Rock, AR (US)

( * ) Notice: Subject to any disclaimer, the term of this patent is extended or adjusted under 35 U.S.C. 154(b) by 0 days.

(21) Appl. No.: 09/512,565

(22) Filed: Feb. 24, 2000

(51) Int. Cl.[7] ..... F16M 1/00
(52) U.S. Cl. ..... 248/640; 440/6
(58) Field of Search ..... 248/640, 642, 248/643, 674, 247, 248, 300, 220.21, 220.22, 224.7, 200, 558; 440/6, 53

(56) References Cited

U.S. PATENT DOCUMENTS

| | | | | |
|---|---|---|---|---|
| 2,497,490 | * | 2/1950 | Daniels | 114/345 |
| 3,802,652 | | 4/1974 | Holton, Jr. | 248/534 |
| 3,844,519 | | 10/1974 | Garrett | 248/226.11 |
| 4,007,902 | | 2/1977 | Pettee | 248/534 |
| 5,100,349 | * | 3/1992 | Perkins et al. | 440/61 |
| 5,704,308 | * | 1/1998 | Anderson | 114/285 |
| 5,795,202 | * | 8/1998 | Williams | 440/113 |
| 6,098,950 | * | 8/2000 | Zupan | 248/674 |

* cited by examiner

*Primary Examiner*—Anita M. King
*Assistant Examiner*—Holly N. Sy
(74) *Attorney, Agent, or Firm*—Leonard Bloom

(57) ABSTRACT

A bracket having a wedge-shaped lower body and an upper body. The upper body has an end formed at a right angle with respect to the faces of the upper body and an opposite end which is formed at a selected angle with respect to the faces of the upper body. The first end of the lower body is attached to a selected end of the upper body wherein the upper body is coplanar with the lower body or the lower body is at a selected angle with respect to the upper body. The bracket is mounted, preferably on an upright surface, with the upper body serving as a support to which selected objects may be removably connected.

11 Claims, 6 Drawing Sheets

SUPPORT BRACKET

BACKGROUND OF THE INVENTION

1. Field of the Invention

The invention is directed to a support bracket and in particular, to a support bracket to be mounted on an upright surface and to which selected items may be attached.

2. Description of Related Art

Many support brackets are known to which items may be attached. In the field of boats, fishing gear and fishing equipment, the following brackets are disclosed. In U.S. Pat. No. 3,802,652, Holton Jr. discloses a bracket for a fishing rod with an angled arm having an opening for the fishing rod at the top portion of the arm. The bottom end of the angled arm is received in a bracket attached to the gunwale of the boat. In U.S. Pat. No. 3,844,519, Garrett discloses a holder for displaying a gasoline lantern on a small boat. In U.S. Pat. No. 4,007,902, Pettee discloses a fishing rod holder comprised of hollow interconnecting upper and lower members positioned at acute angles to each other and attached to a boat hull. An opening is provided on the upper member for a fishing pole.

There is a need for a simple bracket which is easily mounted on a surface such as the back or gunwale of a small boat and to which items may be attached.

BRIEF SUMMARY OF THE INVENTION

It is an object of the present invention to provide a versatile simple bracket which is easily mounted.

It is a further object of the present invention to provide a support bracket which can be angled in at least two different directions.

In accordance with the teachings of the present invention, there is disclosed a bracket to be mounted on an upright surface on a boat, wherein the bracket is a support for fishing equipment. The bracket has, in combination, an elongated lower body having a first end, an opposite second end, a first side and an opposite second side, a front face and an opposite back face. The first end has a width greater than the second end wherein the lower body has a side to side wedge shape. The front face and the back face have a distance therebetween, the distance being greater at the first end than at the second end such that the lower body has a front to back wedge shape. The first end of the lower body is substantially at right angles with respect to the sides and the faces of the lower body. An upper body has a first face and an opposite second face, a first side and an opposite second side, a first end and an opposite second end. The first end of the upper body is substantially at right angles with respect to the faces and sides of the upper body. The second end of the upper body is formed at a selected angle with respect to the faces of the upper body. When the first end of the upper body abuts the first end of the lower body, the lower body and the upper body are coplanar; when the second end of the upper body abuts the first end of the lower body, the upper body is disposed at the selected angle with respect to the lower body. Means are provided for attaching the first end of the body to a selected end of the upper body. Means are provided for attaching the lower body to the upright surface on the boat, such that the bracket serves as a support to which selected fishing equipment may be removably connected.

In further accordance with the teachings of the present invention, there is disclosed a bracket with a wedge-shaped lower body having a first end and an opposite second end. The second end is more narrow than the first end. An upper body has a first end and an opposite second end, a first face and an opposite second face. The first end of the upper body is at a right angle with respect to the faces of the upper body, the second end of the upper body is at a selected angle with respect to the faces of the upper body. Means are provided to attach the first end of the lower body to a selected end of the upper body. When the first end of the lower body is attached to the first end of the upper body, the lower body and the upper body are coplanar. When the first end of the lower body is attached to the second end of the upper body, the upper body is disposed at a selected angle with respect to the lower body. The upper body of the bracket serves as a support to which selected objects may be removably connected.

These and other objects of the present invention will become apparent from a reading of the following specification taken in conjunction with the enclosed drawings.

DESCRIPTION OF THE PREFERRED EMBODIMENT

Figure 1:
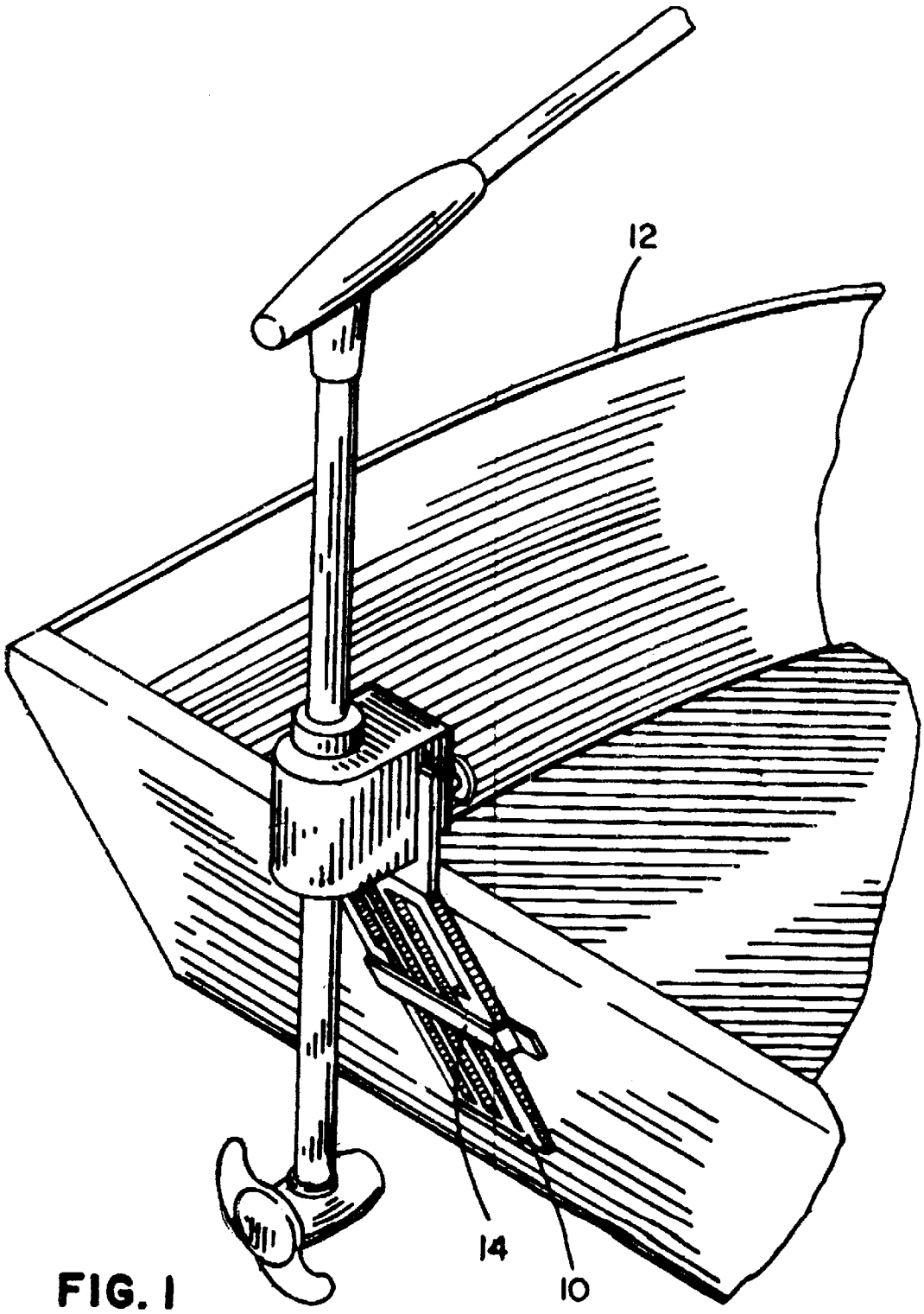
FIG. 1 is a perspective view of the present invention mounted on the bow of a boat with a trolling motor attached to the upper body of the bracket.

Referring now to FIG. 1, the bracket 10 of the present invention is mounted on the back of a boat 12 in a typical use of the invention. The bracket 10 may be mounted on any upright surface which is perpendicular or at an angle to a base of reference. The upright surface may be used if the bracket 10 is mountable in other than a substantially horizontal manner. Preferably, the upright surface has a U-shaped support 14 attached horizontally thereto into which the bracket may be inserted as will be described. The invention is not limited to a U-shaped support since other means of mounting the bracket 10 on an upright surface may be used. The bracket 10 is a support for objects which are removably attached to the bracket. Preferably, the objects to be attached have an opening in which the bracket may be received and a clamping means to secure the object to the bracket. The objects may be a trolling motor, fishing rods, communication equipment or anything which is desired to be conveniently available and elevated above the surface.

Figure 2:
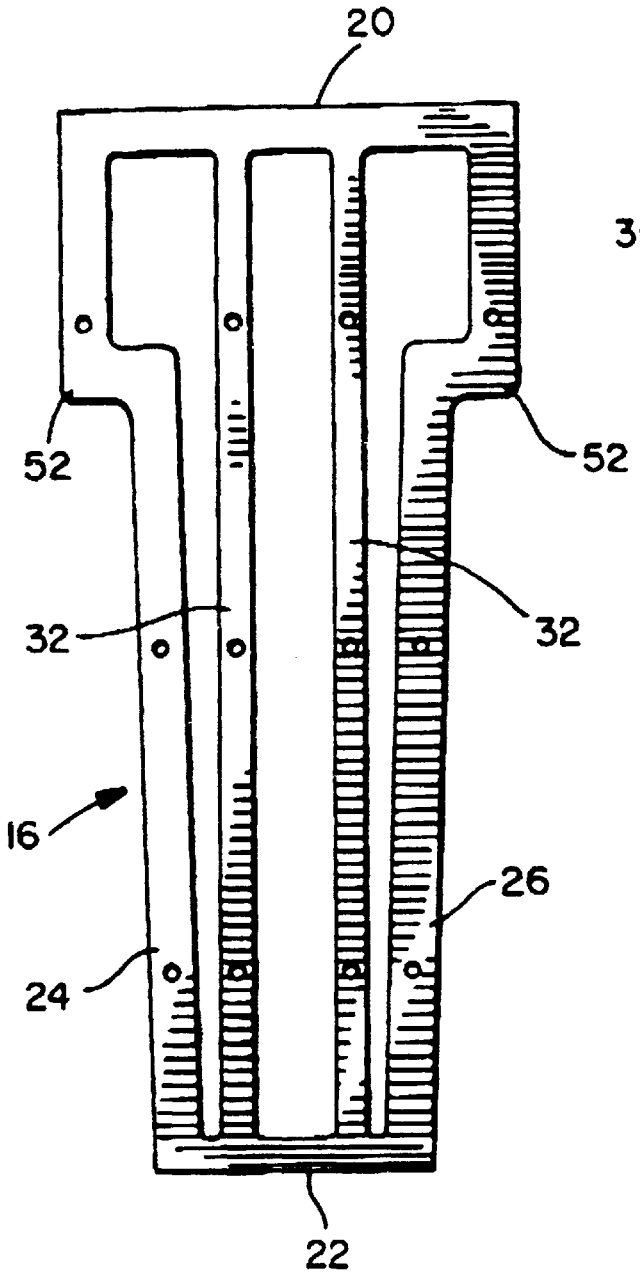
FIG. 2 is a top plan view of the lower body of the present invention.
Figure 3:
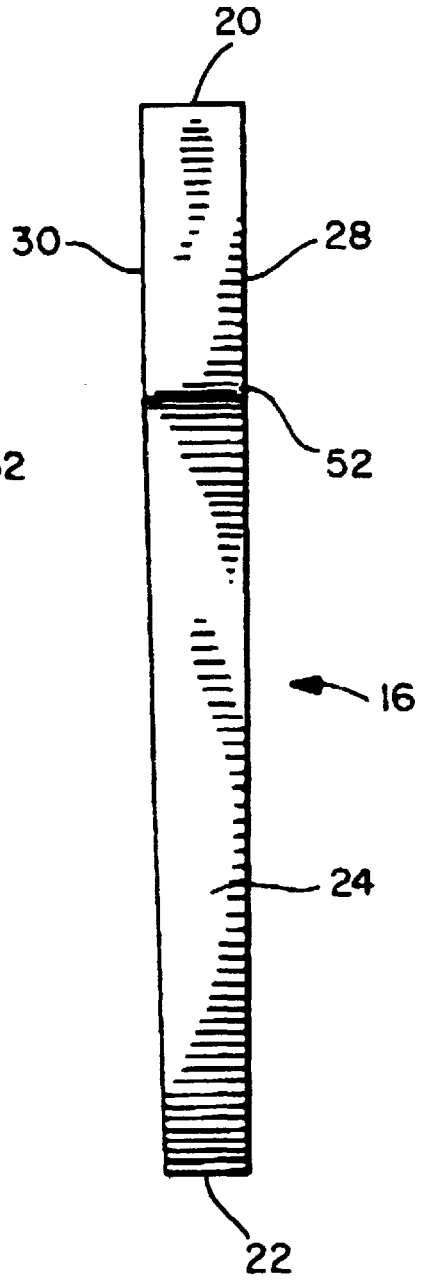
FIG. 3 is a side elevation view of the lower body of FIG. 2.

The bracket 10 has a lower body 16 and an upper body 18 as shown in FIGS. 2 and 3. The lower body 16 is elongated with a first end 20, an opposite second end 22, a first side 24, an opposite second side 26, a front face 28 and an opposite back face 30. The first end 20 has a width greater than the second end 22 such that the lower body 16 has a side to side wedge shape. The front face 28 and the back face 30 have a distance therebetween which is the thickness of the lower body 16. The distance is greater at the first end 20 than at the second end 22 such that the lower body 16 also has a front to back wedge shape. The first end 20 of the lower body 16 is substantially at right angles with respect to the sides 24, 26 and faces 28, 30 of the lower body 16. Preferably the lower body 16 is not a solid unit but has a plurality of struts 32 extending from the first end 20 to the second end 24. The struts 32 provide strength to the lower body 16 while reducing the overall weight of the lower body 16.

Figure 5:
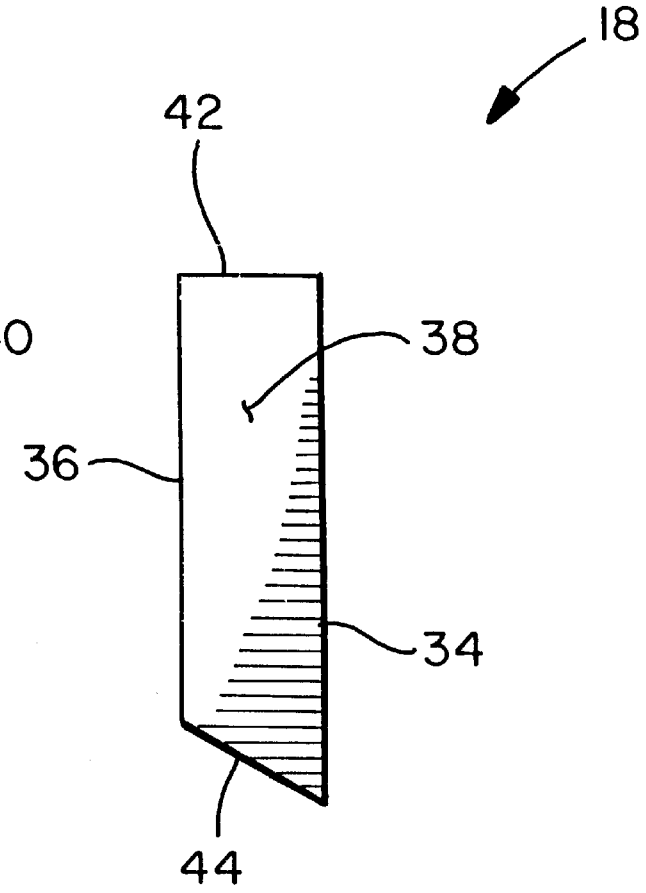
FIG. 5 is a side elevation view of the upper body of FIG. 4.
Figure 4:
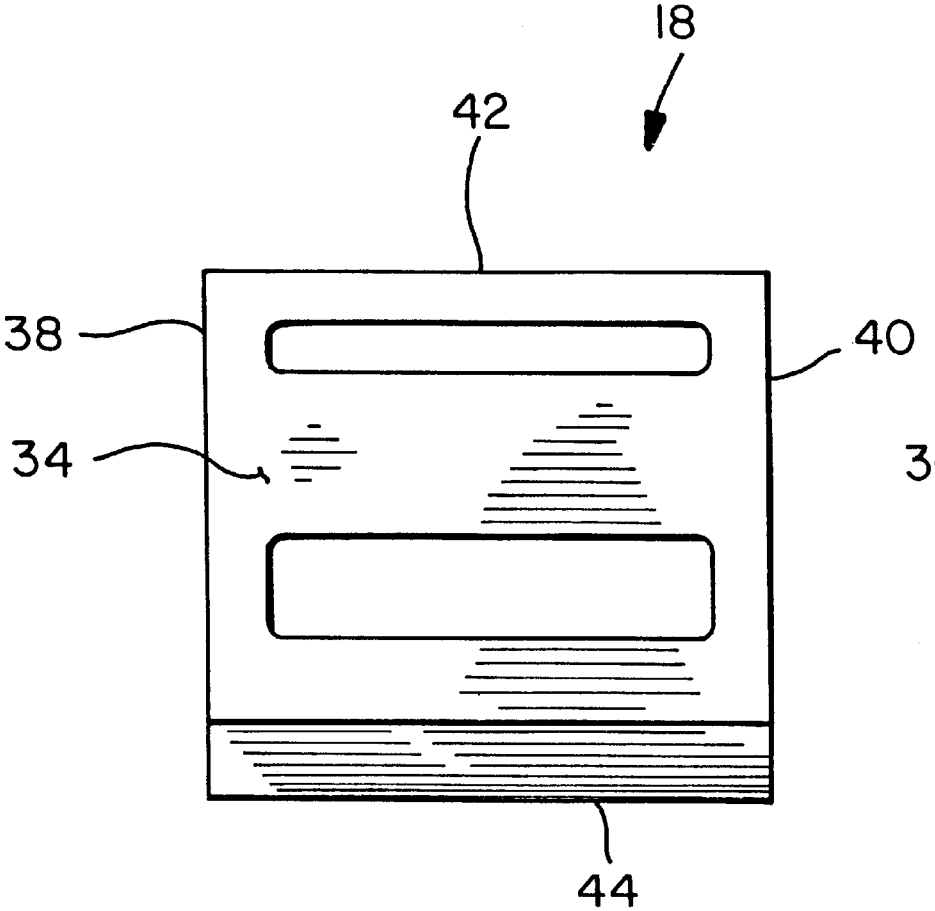
FIG. 4 is a top plan view of the upper body of the present invention.
Figure 6:
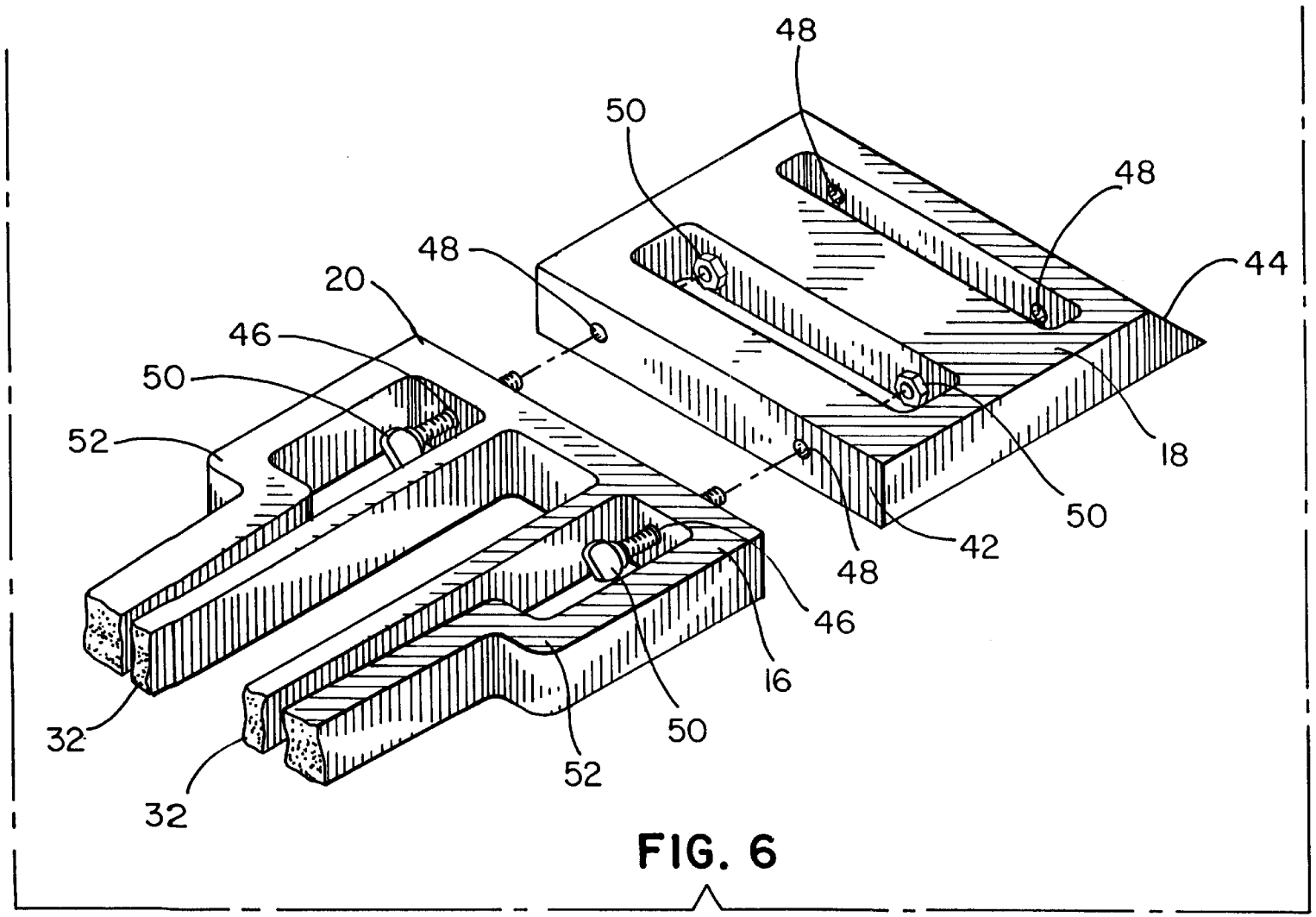
FIG. 6 is a perspective view showing connecting the lower body to the upper body by insertion of bolts in openings.
Figure 8:
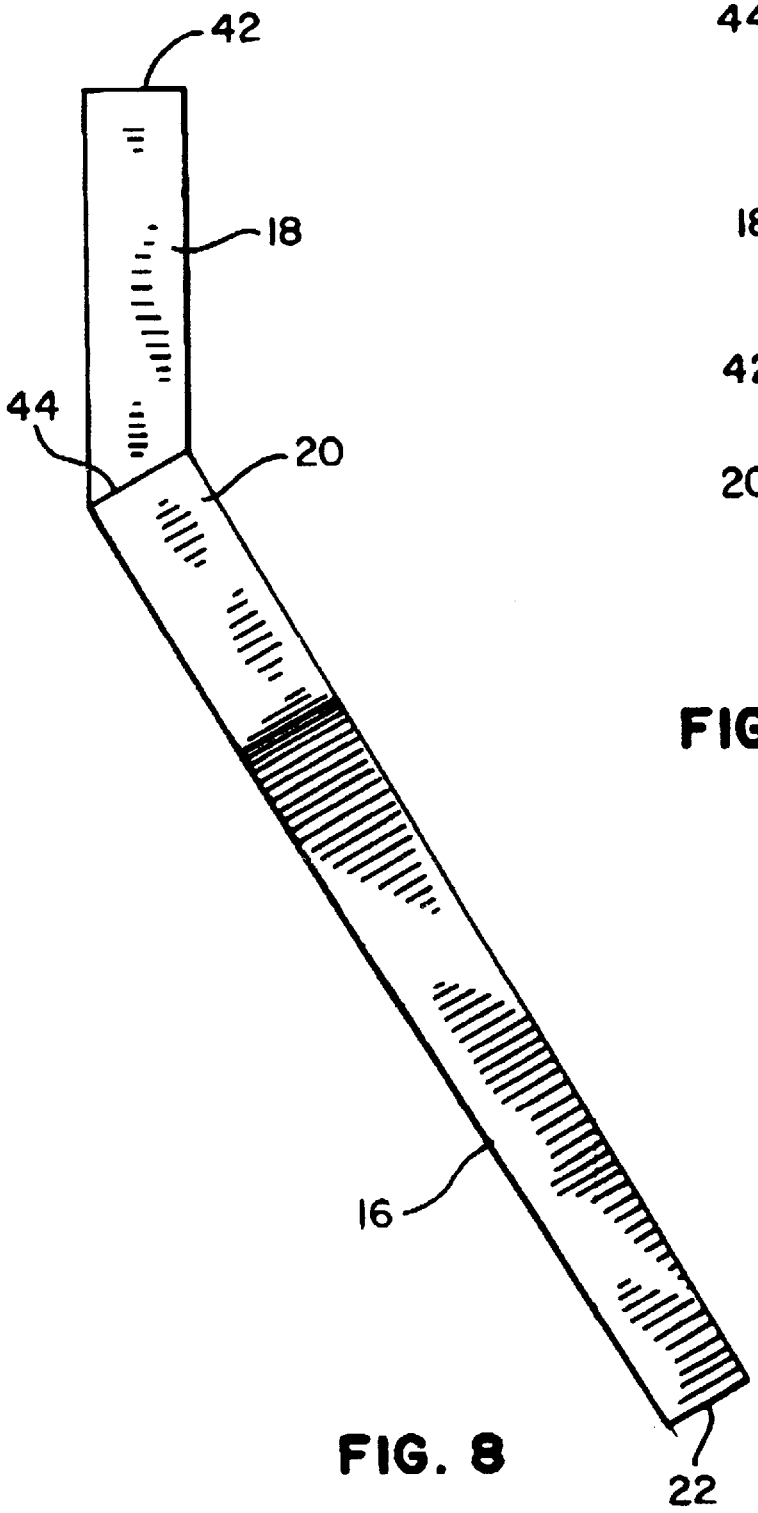
FIG. 8 is a side elevation view showing the lower body and the upper body at an angle when connected.
Figure 7:
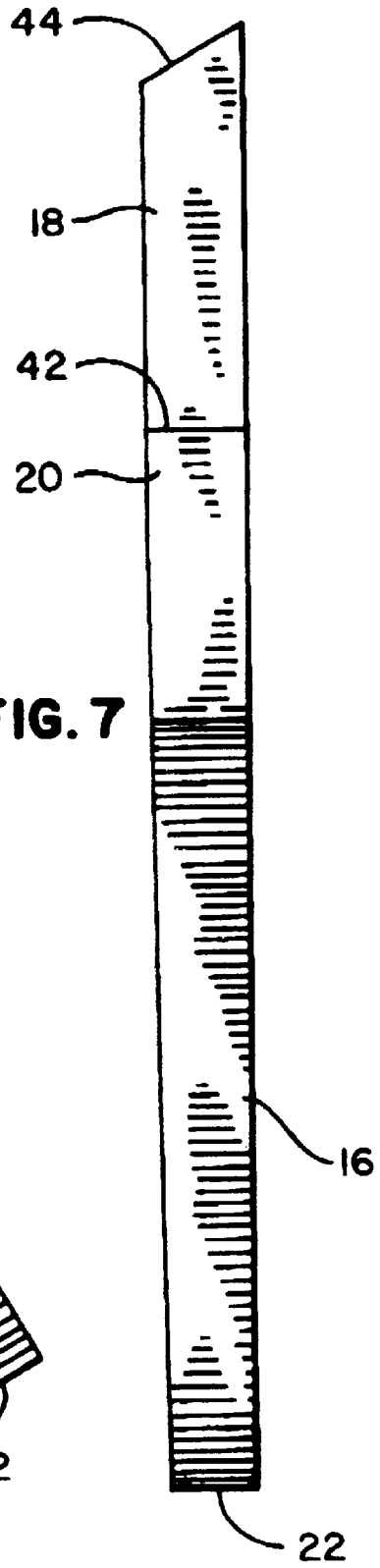
FIG. 7 is a side elevation view showing the lower body coplanar with the upper body when connected.
Figure 9:
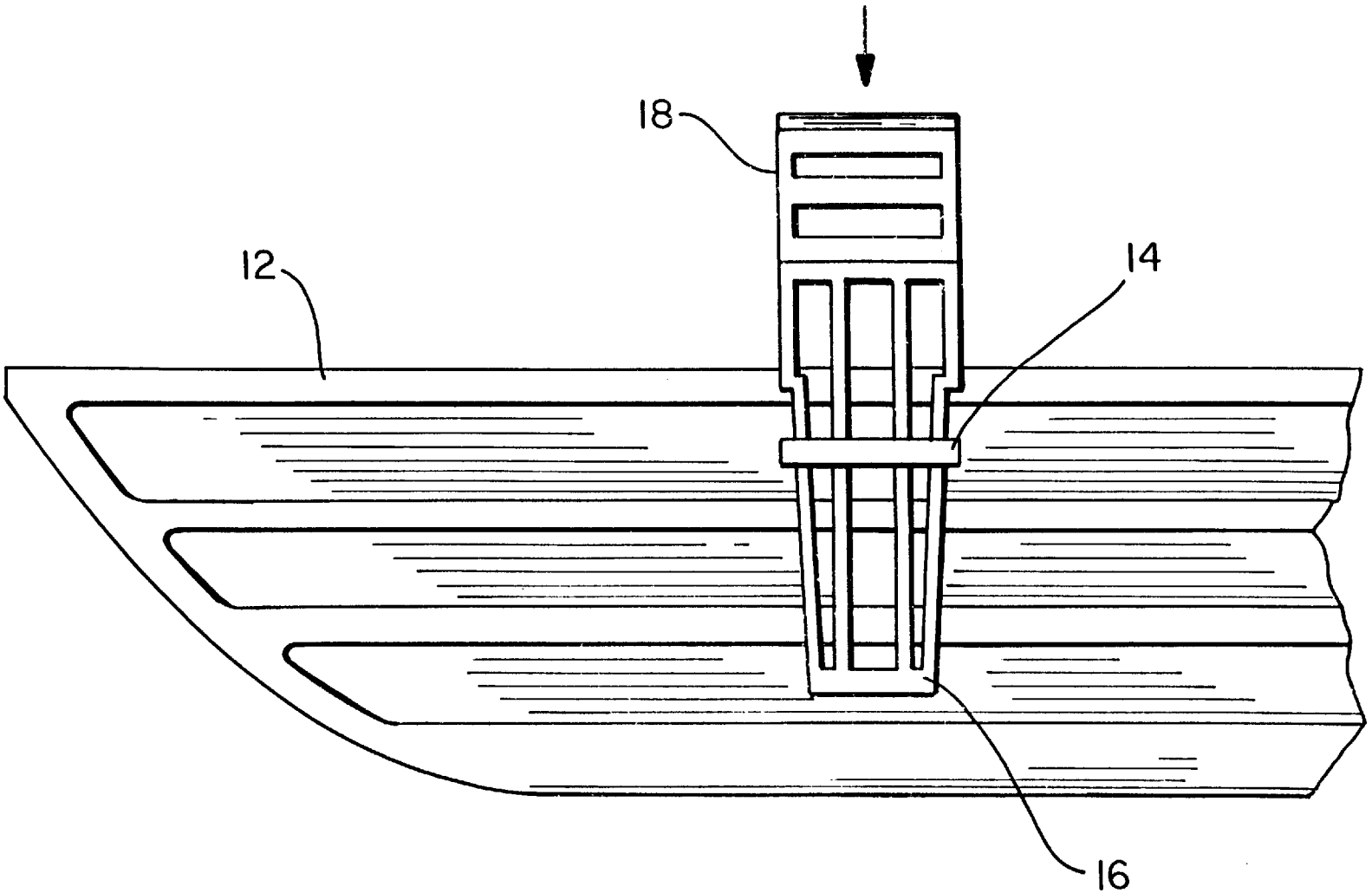
FIG. 9 is a perspective view showing the insertion of the bracket into a U-shaped support on the gunwale of a boat.

The upper body 18 (FIGS. 4 and 5) has a first face 34, an opposite second face 36, a first side 38, an opposite second side 40, a first end 42 and an opposite second end 44. The first end 42 of the upper body 18 is substantially at right angles with respect to the faces 34, 36 and sides 38, 40 of the upper body 18. The second end 44 of the upper body 18 is formed at a selected angle with respect to the faces 34, 36 of the upper body 18. Preferably, the angle is approximately 35° with respect to the first face 34 of the upper body 18.

Preferably at least two spaced-apart holes 46 are formed longitudinally in the first end 20 of the lower body 16. In a like manner at least two spaced-apart holes 48 are formed longitudinally in each the first end 42 and the second end 44 of the upper body 18. The first end 20 of the lower body 16 is abutted to either the first end 42 or the second end 44 of the upper body 18. When so abutted, the holes 46 in the lower body are aligned with the holes 48 on the selected end 42, 44 of the upper body 18. Fastening means 50, such as a threaded bolts with cooperating nuts, are received in the holes 46 in the first end 20 of the lower body 16 and in the holes 48 in the selected first end 42 or second end 44 of the upper body 18. In this manner the lower body 16 is abutted to the upper body 18 and secured thereto. Clamps, snaps, pins and other fastening means may be used to abut the lower body 16 with the upper body 18 as is known to persons skilled in the art. The fastening means may not require the spaced-apart holes as described above.

It is preferred that the opposite sides 24, 26 of the lower body 16 each have a shoulder 52 formed thereon. The shoulder 52 on each side is near the first end 20 of the lower body and is formed such that the portion of the sides of the lower body between the shoulder 52 and the first end 20 is wider than the portion of the lower body between the shoulder 52 and the second end 22.

In use, the upper body 18 is connected to the lower body 16 in either the coplanar or angular configuration as desired. The second end 22 of the lower body is inserted between the upright surface and the U-shaped holder and the bracket 10 is wedged in the U-shaped holder with the shoulders 52 juxtapositioned to the U-shaped holder.

The side-to-side and front-to-back wedge shape of the lower body 16 facilitates insertion of the bracket into the U-shaped holder. However, the wedge shape is not essential if the U-shaped holder is wider than the second end 22 of the lower body 16 but narrower than the width of the lower body 16 between the shoulders 52. The lower body need not have shoulders 52 if the wedge-shaped lower body can be received and held securely in the U-shaped holder or other mounting means on the upright surface. If the mounting means does not have a U-shaped holder, the bracket is mounted with the upper body 18 above the lower body 16.

When the bracket 10 is securely mounted to the upright surface, a selected item is removably attached to the upper body 18. As shown in FIG. 1, the trolling motor has an opening in which the upper body is received and is provided with two, threaded, adjustable clamps so the trolling motor is disposed in the water beneath the boat 12 and the trolling motor is clamped to the upper body 18.

In a similar manner, a fishing rod may be clamped with a C-clamp to the upper body. Any desired item may be attached to the upper body by any convenient means.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A bracket which can be mounted on an upright surface on a boat, wherein the bracket support for fishing equipment, the bracket comprising, in combination:

an elongated lower body having a first end, an opposite second end, a first side and an opposite second side, a front face and an opposite back face, the first end having a width greater than the second end wherein the lower body has a side-to-side wedge shape, the front face and the back face having a distance therebetween, the distance being greater at the first end than at the second end such that the lower body has a front-to-back wedge shape, the first end of the lower body being substantially at right angles with respect to the first side and the opposite second side and the front face and the opposite back face of the lower body, an upper body having a first face and an opposite second face, a first side and an opposite second side, a first end and an opposite second end, the first end of the upper body being substantially at right angles with respect to the front face and the opposite back face and the first side and the opposite second side of the upper body, the second end of the upper body being formed at a selected angle with respect to the front face and the opposite back face of the upper body, wherein, when the first end of the upper body abuts the first end of the lower body, the lower body and the upper body are coplanar, when the second end of the upper body abuts the first end of the lower body, the upper body is disposed at the selected angle with respect to the lower body, means for attaching the first end of the lower body to a selected end of the upper body, and means for attaching the lower body to the upright surface on the boat, such that the bracket serves as a support to which selected fishing equipment may be removably connected.

2. The bracket of claim 1, wherein the first end of the lower body and the first end and the opposite second end of the lower body each have holes formed therein, the holes in the lower body being aligned with the holes in the upper body when the first end of the lower body abuts the selected end of the upper body, fastening means being disposed in the holes to secure the upper body to the lower body.

3. The bracket of claim 1, wherein the second end of the upper body is formed at an angle of 35° with respect to the first face of the upper body.

4. The bracket of claim 1, wherein the lower body is formed of a plurality of spaced-apart struts between the first end and the second end.

5. The bracket of claim 1, wherein the first side and the opposite second side of the lower body each have a shoulder formed thereon near the first end of the lower body such that the shoulders on the first side and the opposite second side of the lower body are juxtapositioned to the means for attaching the lower body to the upright surface on the boat.

6. The bracket of claim 1, wherein the fishing equipment is a trolling motor which is clamped to the upper body.

7. The bracket of claim 1, wherein the means for attaching the lower body to the upright surface on the boat is a U-shaped holder attached horizontally to the upright surface, the second end of the lower body being wedged in the U-shaped holder such that the upper body is above the U-shaped holder.

8. A bracket comprising:

a wedge-shaped lower body having a first end and an opposite second end, the second end being more narrow than the first end and having a first side and an opposite second side, an upper body having a first end and an opposite second end, a first face and an opposite second face, the first end of the upper body being at a right angle with respect to the first face and the opposite second face of the upper body, the second end of the upper body being at a selected angle with respect to the first face and the opposite second face of the upper body, means for attaching the first end of the lower body to a selected end of the upper body, wherein, when the first end of the lower body is attached to the first end of the upper body, the lower body and the upper body are coplanar, when the first end of the lower body is attached to the second end of the upper body, the upper body is disposed at a selected angle with respect to the lower body, the upper body of the bracket serving as the support to which selected objects may be removably connected.

9. The bracket of claim 8, wherein the first end of the lower body and the first end the opposite second end of the upper body each have at least two spaced-apart holes formed therein, the holes in the lower body being aligned with the holes in the upper body when the first end of the lower body abuts the selected end of the upper body, fastening means being disposed in the holes to secure the upper body to the lower body.

10. The bracket of claim 8, wherein the second end of the upper body is formed at an angle of 35° with respect to the first face of the upper body.

11. The bracket of claim 8, wherein the first side and the opposite second side of the lower body each have a shoulder formed thereon near the first end of the lower body such that the shoulders on the first side and the opposite second side of the lower body provide support when the bracket is mounted.

* * * * *